US012140309B2

(12) United States Patent
Hornung et al.

(10) Patent No.: US 12,140,309 B2
(45) Date of Patent: Nov. 12, 2024

(54) DEVICE FOR REGULATING A MIXING RATIO OF A GAS MIXTURE

(71) Applicant: Sensirion AG, Stäfa (CH)

(72) Inventors: Mark Hornung, Stäfa (CH); Andreas Rüegg, Stäfa (CH); Eric Monnin, Stäfa (CH); David Kiliani, Stäfa (CH); Samuel Wehrli, Stäfa (CH); Daniel Traeutlein, Stäfa (CH)

(73) Assignee: Sensirion AG, Stäfa (CH)

( * ) Notice: Subject to any disclaimer, the term of this patent is extended or adjusted under 35 U.S.C. 154(b) by 500 days.

(21) Appl. No.: 17/282,718

(22) PCT Filed: Oct. 5, 2018

(86) PCT No.: PCT/EP2018/077146
§ 371 (c)(1),
(2) Date: Apr. 2, 2021

(87) PCT Pub. No.: WO2019/185181
PCT Pub. Date: Oct. 3, 2019

(65) Prior Publication Data

US 2021/0388985 A1 Dec. 16, 2021

(51) Int. Cl.
*F23N 1/02* (2006.01)
*F23N 5/02* (2006.01)
*F23N 5/18* (2006.01)

(52) U.S. Cl.
CPC ..... *F23N 1/022* (2013.01); *F23N 5/025* (2013.01); *F23N 5/187* (2013.01);
(Continued)

(58) Field of Classification Search
None
See application file for complete search history.

(56) References Cited

U.S. PATENT DOCUMENTS 4,162,889 A 7/1979 Shigemura
5,235,844 A 8/1993 Bonne et al.
(Continued)

FOREIGN PATENT DOCUMENTS

CN 1351700 A 5/2002
CN 203656969 U 6/2014
(Continued)

OTHER PUBLICATIONS

Chinese Office Action and Search Report issued in CN Application No. 201880098415.3, issued Jan. 20, 2023 with partial English Translation.
(Continued)

*Primary Examiner* — Jason Lau
(74) *Attorney, Agent, or Firm* — Foley & Lardner LLP

(57) ABSTRACT

A regulation device for regulating a mixing ratio (x) of a gas mixture comprises a first conduit (1) for carrying a flow of a first gas (e.g., air) and a second conduit (2) for carrying a flow of a second gas (e.g., a fuel gas). The first and second conduits (1, 2) open out into a common conduit (3) in a mixing region (M) to form the gas mixture. A first sensor (S1) is configured to determine at least one thermal parameter of the gas mixture downstream from the mixing region. A control device (10) is configured to receive, from the first sensor, sensor signals indicative of the at least one thermal parameter of the gas mixture and to derive control signals for adjusting device (V1) acting to adjust the mixing ratio, based on the at least one thermal parameter.

42 Claims, 6 Drawing Sheets

(52) U.S. Cl.
CPC .. *F23N 2005/181* (2013.01); *F23N 2005/185* (2013.01); *F23N 2221/10* (2020.01); *F23N 2225/06* (2020.01); *F23N 2239/04* (2020.01)

(56) References Cited

U.S. PATENT DOCUMENTS

| | | | |
|---|---|---|---|
| 5,311,447 | A | 5/1994 | Bonne |
| 5,486,107 | A | 1/1996 | Bonne |
| 6,561,791 | B1 | 5/2003 | Vrolijk et al. |
| 6,581,599 | B1 | 6/2003 | Stenzler |
| 7,188,519 | B2 | 3/2007 | Hornung et al. |
| 10,505,207 | B2 | 12/2019 | Denzler et al. |
| 2002/0115030 | A1 | 8/2002 | Koegl et al. |
| 2005/0247311 | A1 | 11/2005 | Vacchiano et al. |
| 2006/0234171 | A1 | 10/2006 | Tanabe et al. |
| 2006/0248894 | A1 | 11/2006 | Hiramoto et al. |
| 2010/0269922 | A1 | 10/2010 | Isetani |
| 2011/0041847 | A1 | 2/2011 | Cosic |
| 2011/0126545 | A1 | 6/2011 | Loeven, II |

FOREIGN PATENT DOCUMENTS

| | | | |
|---|---|---|---|
| CN | 104279084 | A | 1/2015 |
| CN | 106196564 | A | 12/2016 |
| CN | 107208890 | A | 9/2017 |
| CN | 207424721 | U | 5/2018 |
| DE | 102011079325 | A1 | 1/2013 |
| DE | 20 2018 101 271 | U1 | 3/2018 |
| DE | 10 2016 014 151 | A1 | 5/2018 |
| EP | 1008805 | A1 | 6/2000 |
| EP | 2258984 | A2 | 12/2010 |
| EP | 2495496 | A1 | 9/2012 |
| EP | 2 574 918 | A1 | 4/2013 |
| EP | 2 843 214 | A1 | 3/2015 |
| EP | 3173699 | A1 | 5/2017 |
| EP | 3372267 | A1 | 9/2018 |
| KR | 1020090026370 | A | 3/2009 |
| WO | WO-91/06832 | A1 | 5/1991 |
| WO | WO-2004/015333 | A2 | 2/2004 |
| WO | WO-2006/027858 | A1 | 3/2006 |
| WO | WO-2006/070442 | A1 | 7/2006 |
| WO | WO-2006/080054 | A1 | 8/2006 |
| WO | WO-2009/002262 | A1 | 12/2008 |
| WO | WO-2020/030323 | A1 | 2/2020 |

OTHER PUBLICATIONS

Extended European Search Report mailed Nov. 10, 2020 in European application No. 20192454.5 (6 pgs.).
International Search Report and Written Opinion mailed Jun. 18, 2019 in PCT/EP2018/077146 (11 pages).
Notice of Opposition dated Sep. 7, 2021 from related European Patent Application No. EP3571443, 28 pages.

DEVICE FOR REGULATING A MIXING RATIO OF A GAS MIXTURE

CROSS REFERENCE TO RELATED APPLICATIONS

This application is a national stage entry of International Application No. PCT/EP2018/077146 filed Oct. 5, 2018; the disclosure of which is incorporated by reference herein in its entirety.

TECHNICAL FIELD

The present invention relates to a device for regulating a mixing ratio of a gas mixture comprising a first gas and a second gas, and to a corresponding method.

PRIOR ART

A critical quantity for properly operating a gas-operated energy converter, e.g., a gas burner or an internal combustion engine such as a gas engine or gas motor, is the mixing ratio in the air-fuel mixture provided to the energy converter. The mixing ratio can be defined in different ways. In the present specification, the mixing ratio is expressed as the v/v concentration of the fuel in the air-fuel mixture. However, any other definition can be used. If the fuel concentration is too high, soot may form. If on the other hand the fuel concentration is too low, reduced performance of the energy converter may result. The mixing ratio should therefore be carefully regulated.

U.S. Pat. No. 6,561,791 B1 discloses a regulating system for a gas burner. A fuel gas flow and a combustion air flow are guided to the burner. The fuel gas flow is regulated depending on the pressure in the combustion air flow. To this end, a differential pressure sensor is arranged between the fuel gas flow and the combustion air flow. The sensor generates an electronic signal that is used to regulate a gas valve for the fuel gas.

EP 2 843 214 A1 discloses a method for regulating the mixing ratio between an oxygen carrier gas and a fuel gas in a gas-operated energy converter plant. The mass or volume flow of the oxygen carrier gas and/or fuel gas is detected in order to regulate the mixing ratio. At least two physical parameters of the fuel gas are determined using a sensor, such as its mass or volume flow and its thermal conductivity or heat capacity. A desired value for the mixing ratio is determined from these physical parameters. The desired value is used for the regulation of the mixing ratio.

U.S. Pat. No. 5,486,107 B1 discloses a combustion controller for controlling the mixture of air and fuel gas in a combustion chamber of a combustion system. The combustion controller controls the mixture by opening and closing a fuel valve in a fuel conduit and by opening and closing an air damper in an air conduit, based on sensor inputs from various sensors. These sensors include flow sensors in the fuel conduit and in the air conduit for measuring flow characteristics of the fuel and the air. The sensors further include an additional sensor in the fuel conduit for measuring thermal parameters of the fuel, this sensor being recessed in a dead-ended cavity of the fuel conduit such that it is not exposed to direct flow. The sensors can further include a pressure sensor and a temperature sensor.

In these prior-art systems, regulation of the mixing ratio is based on flow measurements of the air and fuel gas flows upstream from the point where the air and the fuel gas are mixed. This, however, can be problematic for various reasons. First, the air flow rate is typically much larger than the fuel gas flow rate, typical fuel concentrations in the mixture being on the range of only 10% v/v. This places different demands on the flow sensors for the air and fuel flows. Second, modern gas burners can have a high dynamic heating range, it being easily possible for the ratio between maximum and minimum fuel demand to exceed 10:1 or even 20:1. For this reason each of the flow sensors for the air and fuel flows need to cover a large flow range. At the same time utmost precision and long-term stability are required for all operating conditions. Currently available flow sensors are often unable to meet these high demands.

Similar problems also exist for the mixing of other gases than a fuel gas and air, in particular, for the mixing of a functional gas and an oxygen carrier gas, for instance, for the mixing of a gaseous anesthetic and air.

SUMMARY OF THE INVENTION

It is an object of the present invention to provide a regulation device that is capable of achieving reliable and accurate control of the mixing ratio between a first gas and a second gas over a wide dynamic range of the absolute flow rates of the gases, even in the presence of large differences between their flow rates.

A regulation device for regulating a mixing ratio of a gas mixture comprising a first gas and a second gas is proposed, the device comprising:

- a first conduit for carrying a flow of the first gas;
- a second conduit for carrying a flow of the second gas, the first and second conduits opening out into a common conduit in a mixing region to form the gas mixture;
- an adjusting device for adjusting the mixing ratio of the gas mixture; and
- a control device configured to derive control signals for the adjusting device.

The regulation device comprises a first sensor configured to determine at least one thermal parameter of the gas mixture downstream from the mixing region. The control device is configured to receive, from the first sensor, sensor signals indicative of the at least one thermal parameter of the gas mixture and to derive control signals for the adjusting device based on the at least one thermal parameter. The thermal parameter can be, in particular, a parameter indicative of thermal conductivity $\lambda$, thermal diffusivity D, specific heat capacity $c_p$ or volumetric specific heat capacity $c_p\rho$ of the gas mixture, or of any combination thereof.

According to the present invention, it is proposed to carry out a measurement of at least one thermal parameter of the gas mixture downstream from the mixing region, and to use this parameter for controlling the mixing ratio. The value of the thermal parameter will generally depend on the mixing ratio between the first gas and the second gas in the gas mixture. A key advantage is that the measured thermal parameter will generally be independent of the flow rate of the mixture. Therefore the sensor is always operated at approximately the same working point, independently of the flow rate, and the proposed regulating device can accommodate a large dynamic heating range without compromising on accuracy.

In many applications, the flow rate of the second gas will be much lower than the flow rate of the first gas. The proposed measurement of the at least one thermal parameter of the gas mixture then essentially corresponds to a determination of the concentration of the second gas in the gas mixture. The device may be configured accordingly. In particular, the second conduit may have a cross sectional area that is much smaller than the cross-sectional area of the first conduit. In some embodiments, the minimal cross sectional area of the first conduit (i.e., the cross sectional area at the narrowest position of the conduit) is at least five times the minimal cross sectional area of the second conduit. The regulation device may comprise one or more nozzles for injecting the flow of the second gas into the flow of the first gas in the mixing region. This is useful since the main flow will be the flow of the first gas. The direction of injection may be axial, radial or at any other angle to the direction of flow of the first gas immediately upstream from the mixing region.

In some embodiments, the first gas can be an oxygen carrier gas, and the second gas can be some functional gas to be mixed with the oxygen carrier gas. For instance, the first gas can be air or a mixture of air and exhaust gas, and the second gas can be a fuel gas, in particular, a natural gas. As another example, the first gas can be natural air, air enriched with oxygen, any other mixture of oxygen with one or more inert gases, or pure oxygen gas, and the second gas can be a medical gas, in particular, an anesthetic like isoflurane. The regulation device may be specifically configured to be used with such gases. For instance, different connectors and different materials would be used for a regulation device in a gas burner application than for a medical device for dispensing an anesthetic in a hospital.

In some embodiments, the adjusting device comprises a control valve for adjusting a flow rate of the second gas in the second conduit. In other embodiments, the adjusting device may comprise a controllable fan or pump to control the flow rate of the second gas in the second conduit. In addition or in the alternative, the adjusting device may comprise a valve, flap or controllable fan or pump to control the flow of the first gas in the first conduit.

In advantageous embodiments, the first sensor is configured to determine more than one thermal parameter of the gas mixture. In particular, the first sensor can be configured to determine at least two thermal parameters of the gas mixture, the thermal parameters together being indicative of thermal conductivity and thermal diffusivity of the gas mixture.

The control device can then be configured to take into account said at least two thermal parameters. This can be done in different ways. For instance, the control device can be configured to determine a combined parameter derived from the at least two thermal parameters determined by the first sensor, and to derive the control signals based on the combined parameter. In other embodiments, the control device can configured to derive the control signals based on a first one of the thermal parameters determined by the first sensor, e.g., on thermal conductivity, and to carry out a consistency check based on a second one of the thermal parameters determined by the first sensor, e.g., on thermal diffusivity. The control device can be configured to issue an error signal if the consistency check indicates that the second thermal parameter is inconsistent with the first thermal parameter. The error signal may cause the adjusting device to shut off the fuel gas flow. In this manner safety can be increased.

The first sensor can be used not only for regulating the mixing ratio, but it can also be used for determining the density or pressure of the first gas. In particular, the control device can be configured to carry out the following procedure:

setting the adjusting device to a reference state in which the flow of the second gas is interrupted while the flow of the first gas has a non-zero flow rate;

receiving sensor signals from the first sensor, the sensor signals being indicative of at least two thermal parameters of the first gas in the reference state; and based on the at least two thermal parameters of the first gas in the reference state, determining a pressure parameter that is indicative of a density or pressure of the first gas in the reference state.

In particular, the density of the first gas can be readily calculated from its thermal conductivity and its thermal diffusivity if its specific heat capacity is known from other sources. For calculating the absolute pressure of the first gas from its density, it may be necessary to know its temperature. To this end, the first sensor can be configured to measure the temperature of the gas to which it is exposed, and the control device can be configured to base its determination of the pressure parameter not only on the at least two thermal parameters of the first gas, but also on its temperature as determined by the first sensor.

The same procedure can also be carried out for the second gas, using a known specific heat capacity of the second gas and possibly measuring its temperature.

In advantageous embodiments, the control signals are based on a differential measurement that compares a thermal parameter of the gas mixture, as determined by the first sensor, to a thermal parameter of the first gas, which has also been determined by the first sensor. In this manner, calibration errors of the first sensor can be largely cancelled. To this end, the control device can be configured to carry out the following procedure:

setting the adjusting device to a reference state in which the flow of the second gas is interrupted while the flow of the first gas has a non-zero flow rate;

receiving sensor signals from the first sensor, the sensor signals being indicative of at least one thermal parameter of the first gas in the reference state;

setting the adjusting device to an operating state in which both the flow of the second gas and the flow of the first gas have non-zero flow rates;

receiving sensor signals from the first sensor, the sensor signals now being indicative of at least one thermal parameter of the gas mixture in the operating state; and deriving the control signals based on a comparison of the at least one thermal parameter of the gas mixture in the operating state and of the at least one thermal parameter of the first gas in the reference state. The comparison can be carried out, e.g., by forming a difference or quotient of the thermal parameters of the gas mixture and of the first gas.

The regulation device can comprise a fan for transporting the gas mixture to a point of use. The term "fan" is to be understood broadly as encompassing any kind of blower or pump capable of driving a gas flow. In some embodiments, the fan can be arranged downstream from the mixing region, e.g., at the downstream end of the common conduit. In other embodiments, the fan can be arranged upstream from the mixing region, e.g., at the upstream end of the first conduit. If the fan is arranged downstream from the mixing region, the first sensor can advantageously be integrated into the fan.

The first sensor can be employed to detect blockages or malfunctions of the fan. To this end, the control device can be configured to carry out the following procedure:

operating the fan at a plurality of different power levels while the flow of the second gas is interrupted;

for each power level, determining a pressure parameter based on the sensor signals received from the first sensor, the pressure parameter being indicative of density or pressure of the first gas at said power level; and based on the pressure parameters at different power levels, deriving a blockage signal indicating whether a blockage or fan malfunction has occurred.

The control device may be configured to output an error message and/or to shut off the fan and/or to set the adjusting device to a state in which the flows of the first and/or second gas are stopped if the blockage signal indicates that a blockage or fan malfunction has occurred.

In order to improve the homogeneity of the gas mixture, the regulation device may comprise a swirl element arranged in the common conduit downstream from the mixing region and upstream from the first sensor, the swirl element being configured to create turbulence in the gas mixture.

Regulation can be simplified and improved by employing, in addition to the first sensor, one or more further sensors for determining one or more thermal parameters of the first gas and/or of the second gas.

In particular, the regulation device can comprise a second sensor, the second sensor being configured to determine at least one thermal parameter of the first gas. The second sensor can be arranged in the first conduit upstream from the mixing region. In other embodiments, it can be arranged in a bypass that bypasses the mixing region. The control device can be configured to receive, from the second sensor, sensor signals indicative of the at least one thermal parameter of the first gas and to derive the control signals based on the sensor signals received from both the first and second sensors. In other words, the control device can be configured to take into account one or more thermal parameters of both the gas mixture, as determined by the first sensor, and the first gas, as determined by the second sensor. In particular, the control device can be configured to carry out a differential measurement of the gas mixture and the first gas by deriving the control signals based on a comparison of the at least one thermal parameter of the gas mixture, as determined by the first sensor, and of the at least one thermal parameter of the first gas, as determined by the second sensor, e.g., by forming a difference or quotient of these thermal parameters.

In advantageous embodiments, the second sensor is used to determine density and/or pressure of the first gas. To this end, the second sensor can be configured to determine at least two thermal parameters, the at least two thermal parameters determined by the second sensor together being indicative of thermal conductivity and thermal diffusivity of the first gas, and the control device can be configured to derive, based on the at least two thermal parameters determined by the second sensor, an oxygen carrier pressure parameter indicative of density or pressure of the first gas. In this manner, an additional diagnostic parameter is obtained, which is useful for monitoring operation of the regulation device.

In advantageous embodiments, the second sensor is not only used for carrying out a differential measurement of the gas mixture and the first gas, but in addition to also carry out a consistency check. To this end, the first sensor can be configured to determine at least two thermal parameters, the at least two thermal parameters determined by the first sensor together being indicative of thermal conductivity and thermal diffusivity of the mixture. The second sensor can be configured to determine at least two thermal parameters, the at least two thermal parameters determined by the second sensor together being indicative of thermal conductivity and thermal diffusivity of the first gas. The control device can be configured to derive the control signals based on a comparison of one of the thermal parameters determined by the first and second sensors, e.g., thermal conductivity, and to carry out a consistency check based on a comparison of another one of the at least two thermal parameters determined by the first and second sensors, e.g., thermal diffusivity.

Both the first and second sensors can be configured to determine a temperature of the respective gas to which the sensor is exposed, in addition to thermal parameters of the gas. In particular, the first sensor can be configured to determine a temperature of the gas mixture, and the second sensor can be configured to determine a temperature of the first gas. The control device can then be configured to carry out a consistency check based on a comparison of the temperatures of the gas mixture and the first gas. These temperatures should be at least similar. If the first and second sensors are mounted on a heat-conducting common carrier, e.g., on a common printed circuit board, even smaller differences between the temperatures determined by the first and second sensors are expected.

In some embodiments, the regulation device can take into account one or more thermal parameters of the second gas. To this end, the regulation device can comprise a third sensor, the third sensor being configured to determine at least one thermal parameter of the second gas. The third sensor can be arranged in the second conduit upstream from the mixing region. The control device can be configured to receive, from the third sensor, sensor signals indicative of the at least one thermal parameter of the second gas and to derive the control signals based on the sensor signals received from both the first and third sensors.

It is also possible for the regulation device to comprise all three sensors, i.e., a first sensor for determining one or more thermal parameters of the gas mixture, a second sensor for determining one or more thermal parameters of the first gas, and a third sensor for determining one or more thermal parameters of the second gas. The controller can be configured, for instance, to carry out differential measurements between the gas mixture and the first gas as well as between the first gas and the second gas. To this end, the controller can be configured to compare a thermal parameter of the gas mixture, as determined by the first sensor, to a thermal parameter of the first gas, as determined by the second sensor, and to compare said thermal parameter of the first gas to a thermal parameter of the second gas, as determined by the third sensor. The comparisons may involve the forming of differences or quotients of the respective thermal parameters.

The regulation device can be supplemented by one or more mass flow meters. In particular, the regulation device can comprise a first mass flow meter in the first conduit and/or a second mass flow meter in the second conduit, and the control device can be configured to determine one or more mass flow parameters indicative of mass flow in the first and/or second conduit based on mass flow signals from the first and/or second mass flow meters. The control device can be configured to take into account such mass flow parameters when deriving the control signals. In other embodiments, if the first gas is an oxygen carrier gas and the second gas is a fuel gas, the control device can be configured to determine a heating power parameter indicative of heating power of the flow of the gas mixture, based on the one or more mass flow parameters.

Mass flow through the first or second conduit can also be determined by carrying out differential pressure measurements between the first and second conduits. To this end, the regulation device can comprise a flow restrictor in the first or second conduit and a differential pressure sensor configured to determine a differential pressure between the first and second conduits upstream from the flow restrictor. The control device can be configured to determine a mass flow parameter indicative of a mass flow in the first or second conduit based on differential pressure signals from the differential pressure sensor.

The present invention further provides a corresponding method of regulating a mixing ratio of a gas mixture comprising a second gas and a first gas. The method comprises:

creating a flow of the first gas;

creating a flow of the second gas;

forming the gas mixture by mixing the flows of the first gas and the second gas in a mixing region;

determining at least one thermal parameter of the gas mixture downstream from the mixing region using a first sensor; and based on the at least one thermal parameter, adjusting the mixing ratio.

Adjusting the mixing ratio can comprise, for instance, operating a control valve for adjusting a flow rate of the second gas.

As explained in more detail above, it is possible to determine at least two thermal parameters of the gas mixture using the first sensor, the at least two thermal parameters together being indicative of thermal conductivity and thermal diffusivity of the gas mixture, and to take into account the at least two thermal parameters of the gas mixture when adjusting the mixing ratio. In particular, the mixing ratio can be adjusted based on one of the thermal parameters determined by the first sensor, and a consistency check can be carried out based another one of the thermal parameters determined by the first sensor.

As explained in more detail above, advantageous embodiments of the method comprise:

creating a reference state in which the flow of the second gas is interrupted while the flow of the first gas has a non-zero flow rate;

receiving sensor signals from the first sensor, the sensor signals being indicative of at least two thermal parameters of the first gas in the reference state; and based on the at least two thermal parameters of the first gas in the reference state, determining a pressure parameter that is indicative of a density or pressure of the first gas in the reference state.

As explained in more detail above, advantageous embodiments of the method comprise:

creating a reference state in which the flow of the second gas is interrupted while the flow of the first gas has a non-zero flow rate;

receiving sensor signals from the first sensor, the sensor signals being indicative of at least one thermal parameter of the first gas in the reference state;

creating an operating state in which both the flow of the second gas and the flow of the first gas have non-zero flow rates;

receiving sensor signals from the first sensor, the sensor signals being indicative of at least one thermal parameter of the gas mixture in the operating state; and adjusting the mixing ratio based on a comparison of the at least one thermal parameter of the gas mixture in the operating state and of the at least one thermal parameter of the first gas in the reference state.

As explained in more detail above, the method can comprise transporting the gas mixture to a point of use using a fan. The method then can comprise:

operating the fan at a plurality of different power levels while the flow of the second gas is interrupted;

for each power level, deriving a pressure parameter from sensor signals determined by the first sensor, the pressure parameter being indicative of density or pressure of the first gas at said power level; and based on the pressure parameters at different power levels, deriving a blockage signal indicating whether a blockage or fan malfunction has occurred.

As explained in more detail above, the method can further employ a second sensor for determining one or more thermal parameters of the first gas. In particular, the method can comprise:

determining at least one thermal parameter of the first gas upstream from the mixing region using a second sensor; and adjusting the mixing ratio based on the at least one thermal parameter of the gas mixture determined by the first sensor and on the at least one thermal parameter of the first gas determined by the second sensor.

As explained in more detail above, the second sensor can be employed to determine density or pressure of the first gas. In particular, the method can comprise determining at least two thermal parameters by the second sensor, the at least two thermal parameters determined by the second sensor together being indicative of thermal conductivity and thermal diffusivity of the first gas, and deriving an oxygen carrier pressure parameter based on the at least two thermal parameters determined by the second sensor, the oxygen carrier pressure parameter being indicative of density or pressure of the first gas.

As explained in more detail above, the second sensor can be employed to carry out a consistency check. In particular, the method can comprise:

determining at least two thermal parameters of the gas mixture using the first sensor, the at least two thermal parameters determined by the first sensor together being indicative of thermal conductivity and thermal diffusivity of the gas mixture; and determining a first thermal parameter and a second thermal parameter of the first gas using the second sensor, the at least two thermal parameters determined by the second sensor together being indicative of thermal conductivity and thermal diffusivity of the first gas;

adjusting the mixing ratio based on a comparison of one of the thermal parameters determined by the first and second sensors; and carrying out a consistency check based on a comparison another one of the thermal parameters determined by the first and second sensors.

As explained in more detail above, the method can comprise:

determining a temperature of the gas mixture using the first sensor;

determining a temperature of the first gas using the second sensor; and carrying out a consistency check based on a comparison of the temperatures of the gas mixture and the first gas.

As explained in more detail above, the method can further comprise:

determining at least one thermal parameter of the second gas using a third sensor; and adjusting the mixing ratio based on the at least one thermal parameter of the gas mixture determined by the first sensor and the at least one thermal parameter of the second gas determined by the third sensor.

As explained in more detail above, the method can further comprise measuring a mass flow rate of the first gas and/or a mass flow rate of the second gas. Measuring one of these mass flow rates can comprise:

passing the flow of the first gas or the flow of the second gas through a flow restrictor;

determining a differential pressure between the first gas and the second gas upstream from the flow restrictor; and determining a mass flow parameter indicative of a mass flow rate of the first gas or the second gas based on said differential pressure.

As explained in more detail above, in some embodiments the second gas can be a fuel gas. In other embodiments, the second gas can be a medical gas, for instance, a gaseous anesthetic. In some applications, the gas mixture may subsequently be used in a medical procedure, for instance, to start or maintain anesthesia in a human or animal body. In other embodiments, the second gas is not a medical gas, and the gas mixture is not subsequently used in a medical procedure. To the extent that methods of treatment of the human or animal body by surgery or therapy practiced on the human or animal body are excluded from patentability in a jurisdiction, such excluded methods are to be understood to be disclaimed from the scope of the present invention in such jurisdiction.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Regulating the Mixing Ratio with a Single Sensor

Figure 1:
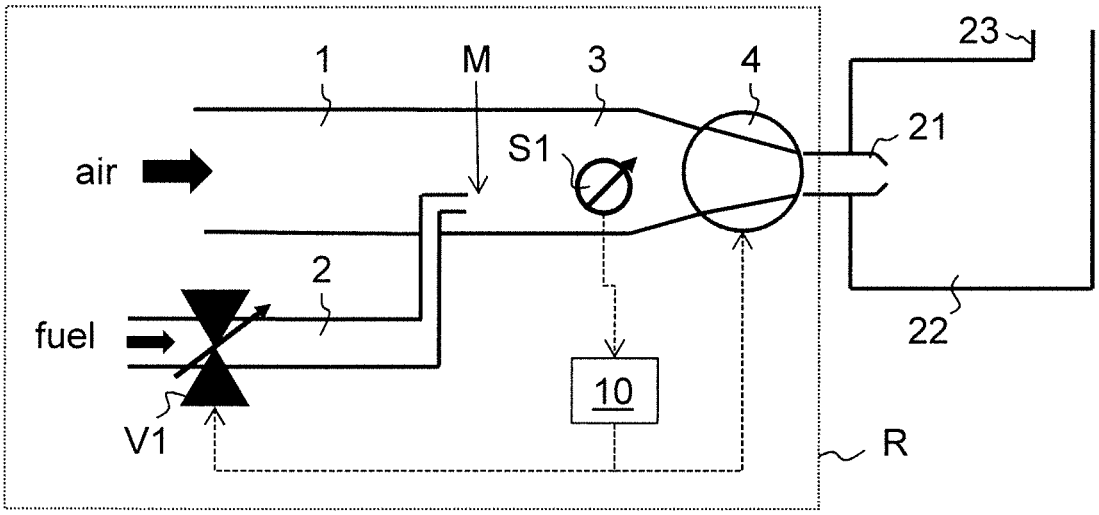
FIG. 1 shows, in a highly schematic manner, a gas burner comprising a regulation device according to a first embodiment.

FIG. 1 shows, in a highly schematic manner, a gas burner. A gas mixture enters a combustion chamber 22 through one or more burner nozzles 21. Flue gas exits the combustion chamber through an exhaust 23.

Supply of the gas mixture is regulated by a regulation device R. The regulation device R comprises an air conduit 1, through which air enters the regulation device, and a fuel gas conduit 2, through which a fuel gas, for instance a natural gas, enters the regulation device. The fuel gas flow in the fuel gas conduit 2 is regulated by an adjusting device in the form of a fuel control valve V1. In a mixing region M, the fuel gas conduit 2 opens out into the air conduit 1 to form a combustible gas mixture consisting of the fuel gas and air. The portion of the air conduit 1 that is downstream from the point of injection of the fuel gas flow into the air flow can be considered a common conduit 3 for the gas mixture. A fan 4 is arranged at the downstream end of common conduit 3 to transport the gas mixture from common conduit 3 to burner nozzle 21.

A first sensor S1 for determining one or more thermal parameters of the gas mixture is arranged in common conduit 3 downstream from mixing region M and upstream of fan 4 such that sensor S1 is exposed to the gas mixture. Advantageously sensor S1 is arranged and/or configured in such a manner that the directed flow of the gas mixture in the common conduit 3 does not directly pass over sensor S1. For instance, sensor S1 may be received in a dead-ended recess in a side wall of common conduit 3. In addition or in the alternative, sensor S1 may be protected by a permeable membrane allowing only for diffusive gas exchange between common conduit 3 and sensor S1, thereby preventing a directed flow of the gas mixture over sensor S1.

A control device 10 receives sensor signals from first sensor S1. Based on the sensor signals, control device 10 derives control signals for adjusting the degree of opening of fuel control valve V1. Control device 10 further adjusts the electric power with which fan 4 is operated.

Figure 2:
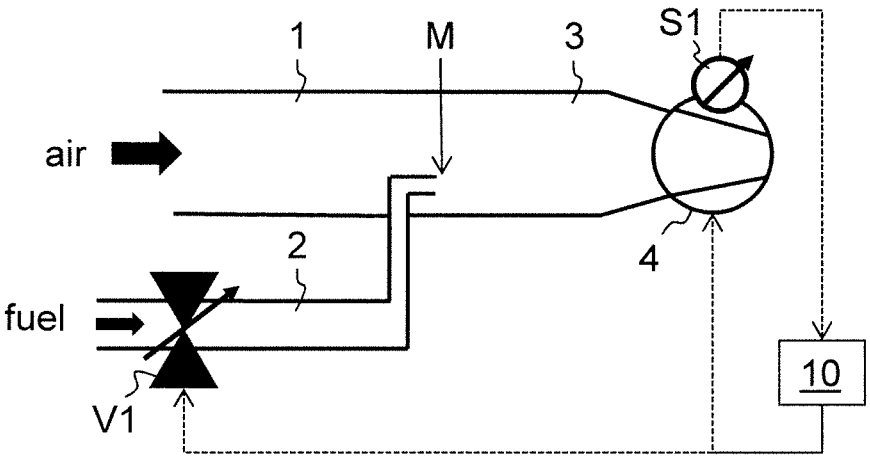
FIG. 2 shows, in a highly schematic manner, a regulation device according to a second embodiment.

FIG. 2 illustrates an alternative embodiment of a regulation device. In this embodiment, first sensor S1 is integrated into fan 4, i.e., it is contained within the housing of fan 4. In other embodiments, sensor S1 may be arranged downstream from fan 4.

Figure 3:
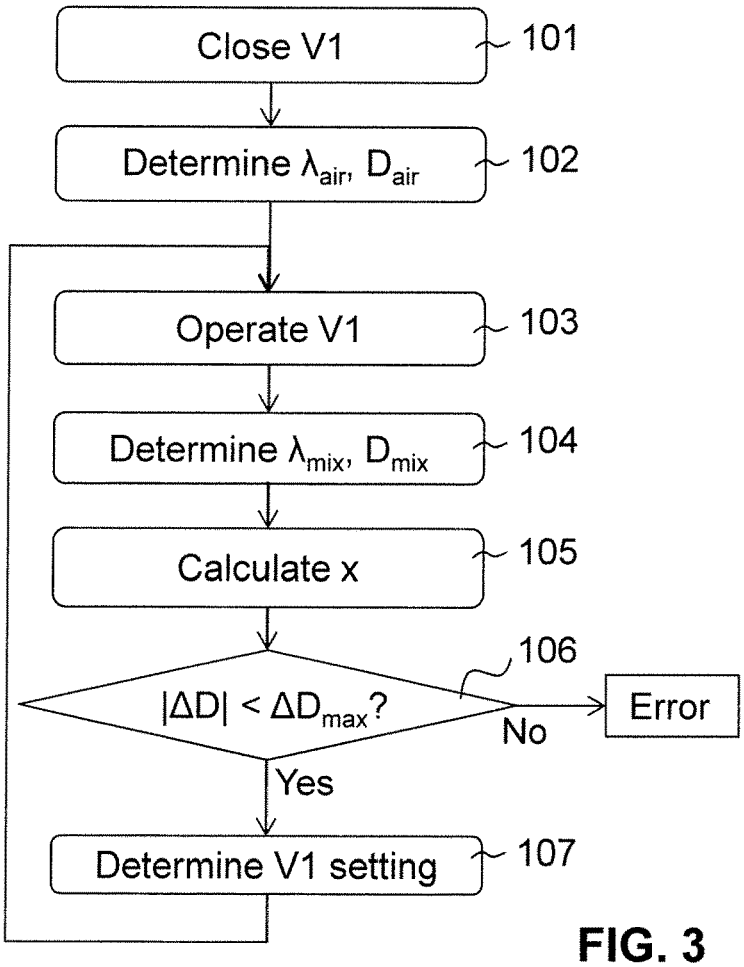
FIG. 3 shows a flow chart for a method of regulating a mixing ratio according to a first embodiment.

FIG. 3 illustrates a method of regulating the mixing ratio of a gas mixture according to a first embodiment, using a regulation device as illustrated in FIG. 1 or 2.

In step 101, fuel control valve V1 is closed while fan 4 is operated at some predetermined fan power or fan speed to cause a flow of air through air conduit 1 and common conduit 3.

In step 102, first sensor S1 is operated to determine the thermal conductivity $\lambda_{air}$ and the thermal diffusivity $D_{air}$ of the air that now passes through common conduit 3.

In step 103, fuel control valve V1 is opened to admit a fuel gas flow into the air flow.

In step 104, first sensor S1 is operated to determine the thermal conductivity $\lambda_{mix}$ and the thermal diffusivity $D_{mix}$ of the resulting gas mixture.

In step 105, the mixing ratio x of the gas mixture is determined. This can be done as follows. For the purposes of the present discussion, the mixing ratio x may be defined as the v/v concentration of the fuel gas in the gas mixture. Using this definition, to a good approximation, the thermal conductivity $\lambda_{mix}$ depends linearly on the mixing ratio x:

$$\lambda_{mix}=x\cdot\lambda_{fuel}+(1-x)\cdot\lambda_{air} \quad \text{Eq. (1)}$$

Solving Eq. (1) for x leads to:

$$x=(\lambda_{mix}-\lambda_{air})/(\lambda_{fuel}-\lambda_{air}) \quad \text{Eq. (2)}$$

The values of $\lambda_{air}$ and $\lambda_{mix}$ are known from the measurements in steps 102 and 104. The value of $\lambda_{fuel}$ is not directly measured; however, a predetermined value for a representative fuel gas (e.g., an "average" natural gas) may be used.

It is noted that the thermal diffusivities do not enter Eq. (2), i.e., the thermal diffusivities provide redundant information. Also the thermal diffusivity $D_{mix}$ depends linearly on the mixing ratio x to a good approximation:

$$D_{mix}=x\cdot D_{fuel}+(1-x)\cdot D_{air} \quad \text{Eq. (3)}$$

Using this relationship, a consistency check is carried out in step 106 by checking whether the measured value of the thermal diffusivity $D_{mix}$ corresponds to the expected value as calculated by Eq. (3), using the value of the mixing ratio x as determined by Eq. (2). For the consistency check, a predetermined value of $D_{fuel}$ for a representative fuel gas may be used. If the difference $\Delta D$ between the measured and calculated values of $D_{mix}$ exceeds a threshold $\Delta D_{max}$, an error message is outputted by the control device 10, and the fuel control valve V1 is closed as a safety measure.

In step 107, a control algorithm is carried out, wherein the actual mixing ratio as determined from the sensor signals of sensor S1 (the process variable of the control algorithm) is compared to a desired mixing ratio (the set point of the control algorithm), and a new setting of the gas control valve V1 is accordingly determined. Any known control algorithm can be employed, e.g., the well-known proportional-integral-differential (PID) control algorithm.

The process then loops back to step 103, where fuel control valve V1 is operated in accordance with the new setting.

Determination of Air Pressure Using Sensor S1

The values of the thermal conductivity $\lambda_{air}$ and the thermal diffusivity $D_{air}$ of the air in the common conduit 3 as determined in step 102 can be used to determine the density $\rho_{air}$ and/or the pressure $p_{air}$ of the air as follows. The thermal diffusivity D of a gas is related to its thermal conductivity $\lambda$, its density $\rho$ and its specific heat capacity $c_p$ by the following equation:

$$D=\lambda/(c_p\rho) \quad \text{Eq. (4)}$$

If both thermal conductivity and thermal diffusivity are known, the volumetric specific heat capacity $c_p\rho$ can be readily calculated using Eq. (4). If the specific heat capacity $c_p$ of the gas is known from another source, it is possible to solve the above equation for the density $\rho$. If also the temperature T of the gas is known, it is readily possible to determine the gas pressure p by the relationship $p=\rho R_{spec}T$, where $R_{spec}$ is the specific gas constant of the gas.

The isobaric specific heat capacity $c_p$ of dry air is well known and is almost independent of temperature and pressure around normal conditions. Also the specific gas constant $R_{spec}$ of dry air is well known. By measuring the thermal conductivity $\lambda_{air}$ and the thermal diffusivity $D_{air}$ of the air in step 102, it is therefore possible to determine the density $\rho_{air}$ of the air. If also the air temperature $T_{air}$ is known, it is furthermore possible to determine the air pressure $p_{air}$. For determining the air temperature $T_{air}$, first sensor S1 may be operated in an absolute temperature mode, or a separate temperature sensor (not shown) may be provided in air conduit 1 and/or common conduit 3. For humid air, appropriate corrections can be applied, as it is well known in the art. A humidity sensor may be provided in air conduit 1 and/or in common conduit 3 for determining the relative humidity of the air in order to be able to apply such corrections.

Detection of Fan Malfunctions or Blockages Using Sensor S1

The air density $\rho_{air}$ or air pressure $p_{air}$ determined in this manner can be used as a further diagnostic parameter. For instance, the air density $\rho_{air}$ or air pressure $p_{air}$ can be used to detect a malfunction of the fan 4 or a blockage of the air conduit 1 or the common conduit 3.

Figure 4:
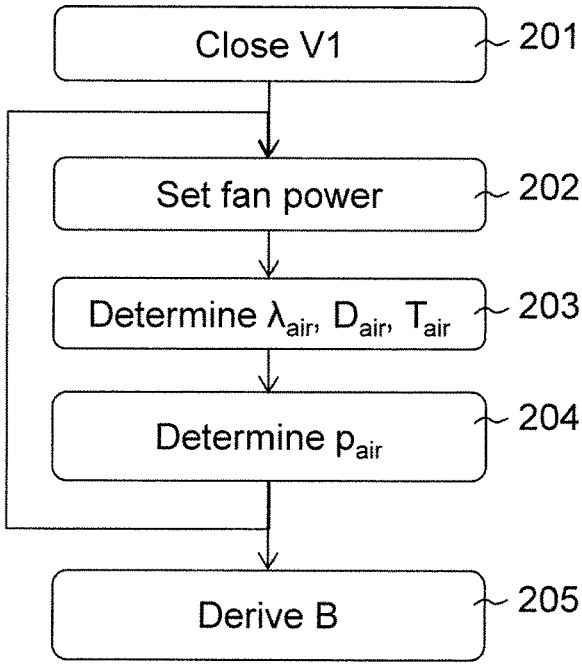
FIG. 4 shows a flow chart for a method of checking whether a blockage or fan malfunction has occurred.

A possible method for detecting such malfunctions or blockages is illustrated in FIG. 4. In step 201, fuel control valve V1 is closed. In step 202, the electric power provided to fan 4 is set to some non-zero value. As a result, air will pass through common conduit 3. In step 203, the thermal conductivity $\lambda_{air}$, the thermal diffusivity $D_{air}$ and the air temperature $T_{air}$ of the air at this fan power are determined, using first sensor S1. In step 204, the air pressure $p_{air}$ or the air density is determined from these parameters, as described above. This procedure is systematically repeated for a predetermined number of different fan powers. The dependence of the air pressure $p_{air}$ or air density on fan power is then compared to an expected dependence to obtain a blockage parameter B. In particular, in the configuration of FIGS. 1 and 2, it is expected that the air pressure $p_{air}$ slightly drops with increasing fan power because of the suction effect created by fan 4. If the air pressure drops much more than expected, this indicates a blockage in air conduit 1 or common conduit 3 upstream of sensor S1. If the air pressure does not drop at all, this indicates a blockage downstream from fan 4 or a malfunction of fan 4. A blockage parameter is derived from the measured data. For instance, blockage parameter B may correspond to the slope of a best-fit line obtained by a linear regression analysis of data pairs corresponding to measured air pressure $p_{air}$ vs. associated fan power.

Swirl Element

Figure 5:
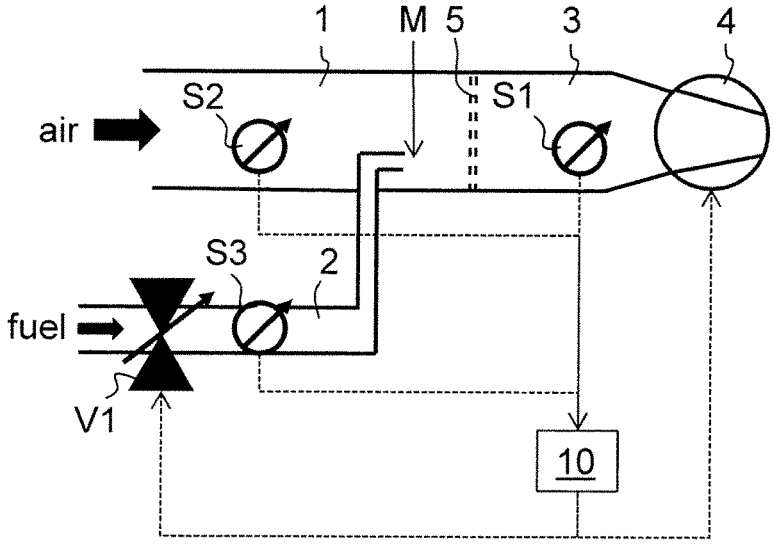
FIG. 5 shows, in a highly schematic manner, a regulation device according to a third embodiment.

In the embodiment of FIG. 5, an optional swirl element 5 is provided in the common conduit 1 downstream from the mixing region M and/or in the mixing region M. The swirl element acts to create turbulence in order to improve homogeneity of the air-fuel mixture.

Using Further Sensors in Air Conduit and/or Fuel Conduit Swirl Element

Further sensors may be provided in air conduit 1 and/or in fuel conduit 2. This is also illustrated in FIG. 5. In this example, a second sensor S2 is provided in air conduit 1 upstream of the mixing region M. In addition or in the alternative, a third sensor S3 is provided in fuel conduit 2 downstream from fuel control valve V1 and upstream of the mixing region M. Like first sensor S1, also second and/or third sensors S2, S3 are advantageously protected from direct exposure to the respective gas flows by disposing each sensor in a dead-ended recess of the wall of the respective conduit, and/or by protecting each sensor by a gas-permeable membrane.

Figure 6:
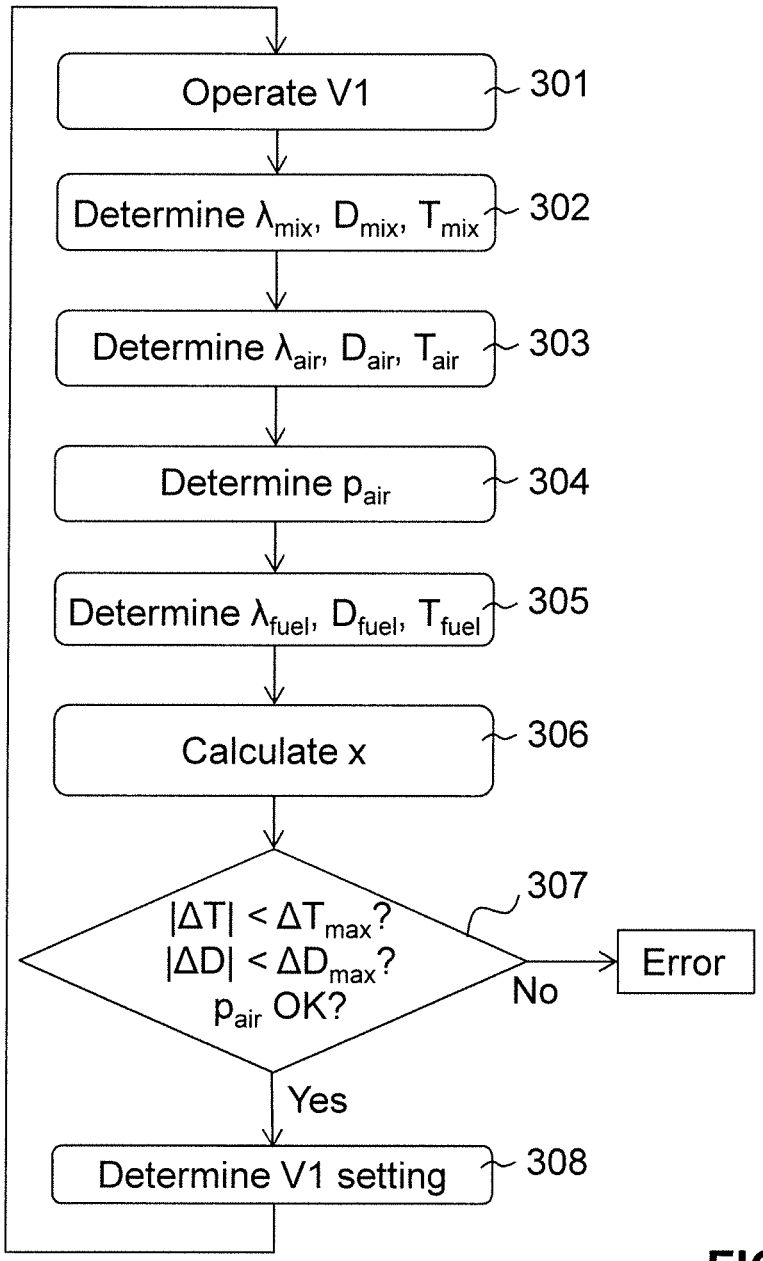
FIG. 6 shows a flow chart for a method of regulating a mixing ratio according to a second embodiment.

FIG. 6 illustrates a possible method of regulating the mixing ratio using sensor S1 as well as sensors S2 and S3.

In step 301, fuel control valve V1 is operated to provide a non-zero flow of the fuel gas.

In step 302, sensor S1 is operated to determine the thermal conductivity $\lambda_{mix}$, the thermal diffusivity $D_{mix}$ and the temperature $T_{mix}$ of the gas mixture in common conduit 3 downstream from the mixing region M.

In step 303, sensor S2 is operated to determine the thermal conductivity $\lambda_{air}$, the thermal diffusivity $D_{air}$ and the temperature $T_{air}$ of the air in air conduit 1 upstream of the mixing region M.

In step 304, the air pressure $p_{air}$ is determined from these quantities. The air pressure $p_{air}$ or the air density as determined from the signals of sensor S2 can be used as an additional diagnostic parameter. In particular, the air pressure $p_{air}$ or air density can be used to detect blockages or malfunctions of the fan 4. For instance, the air pressure or density can be permanently or periodically monitored during operation of the regulation device. Changes in air pressure or density during operation of the fan at constant fan power may indicate a blockage or fan malfunction. In contrast to the embodiment of FIG. 4, determination of the air pressure or density from the signals of sensor S2 is possible even during normal operation of the regulation device, whereas in the embodiment described above in conjunction with FIG. 4, blockages and malfunctions can be detected only while the fuel supply is stopped.

In step 305, sensor S3 is operated to determine the thermal conductivity $\lambda_{fuel}$, the thermal diffusivity $D_{fuel}$ and the temperature $T_{fuel}$ of the fuel gas in fuel conduit 2 downstream from fuel control valve V1 and upstream of mixing region M.

In step 306, the mixing ratio x is determined, based on Eq. (3), using the values of $\lambda_{mix}$ as determined by sensor S1, of $\lambda_{air}$ as determined by sensor S2, and of $\lambda_{fuel}$ as determined by sensor S3. If sensor S2 is omitted, it is instead possible to use the value of $\lambda_{air}$ as determined by sensor S1 while the gas control valve is closed, as described in conjunction with FIG. 3. If sensor S3 is omitted, it is possible to use the value of $\lambda_{fuel}$ as determined beforehand for a typical fuel gas.

In step 307, several diagnostic checks are carried out. In particular, a first consistency check is carried out by determining whether the measured value of the thermal diffusivity $D_{mix}$ corresponds to the expected value as calculated by Eq. (3), using the value of the mixing ratio x as determined by Eq. (2), as already described in conjunction with FIG. 3. In contrast to the embodiment of FIG. 3, the actual values of the thermal diffusivities of the oxygen carrier gas and of the fuel gas, as determined by sensors S2 and S3, can be used for this consistency check. If the absolute value of the difference ΔD between the measured and calculated values of $D_{mix}$ exceeds a threshold $\Delta D_{max}$, an error message is outputted by the control device 10, and fuel control valve V1 is closed as a safety measure. A second consistency check is carried out by checking whether the temperatures $T_{mix}$ and $T_{air}$ as measured by sensors S1 and S2, respectively, differ. If the absolute value of the temperature difference $\Delta T = T_{mix} - T_{air}$ exceeds a threshold $\Delta T_{max}$, again an error message is outputted by the control device 10, and the fuel control valve V1 is closed as a safety measure. This consistency check is particularly powerful if sensors S1 and S2 are mounted on a common carrier that is heat conducting, such as a common printed circuit board. A third consistency check is carried out by checking whether the air pressure $p_{air}$ as determined from the signals of sensor S2 indicates a blockage or a malfunction of the fan, as described above. If this is the case, again an error message is outputted by the control device 10, and the fuel control valve V1 is closed as a safety measure.

In step 308, a control algorithm is carried out to derive control signals for fuel control valve V1, as described above in conjunction with step 107 in the embodiment of FIG. 3.

If sensor S2 is used for determining the value of $\lambda_{air}$, the influence of any parameters that affect the output of both sensors S1 and S2, such as the relative humidity of the air, is largely cancelled when forming the difference $\lambda_{mix} - \lambda_{air}$. This is especially true if the mixing ratio (i.e., the fuel concentration in the gas mixture) is small, because in this case any change of $\lambda_{air}$ will be reflected by an almost identical change of $\lambda_{mix}$. In this manner more precise control of the mixing ratio can be achieved.

If sensor S3 is used for determining the value of $\lambda_{fuel}$, the regulation device becomes adaptive to the fuel gas. On the one hand, the determination of the mixing ratio takes into account the real value of $\lambda_{fuel}$ rather than some predetermined value for a representative fuel gas. This improves accuracy of the control of the mixing ratio. On the other hand, by determining $\lambda_{fuel}$, $D_{fuel}$ and $T_{fuel}$, and optionally by taking into account the pressure $p_{air}$ obtained by sensor S2 (assuming that the pressures in air conduit 1 and in fuel conduit 2 are approximately equal), it becomes possible to precisely characterize the fuel gas. In particular, based on the measured parameters $\lambda_{fuel}$, $D_{fuel}$, $T_{fuel}$ and optionally $p_{air}$, it becomes possible to determine an optimum mixing ratio for which optimized combustion is expected, and to set the set point of the control algorithm accordingly. In addition or in the alternative, it becomes possible to determine combustion parameters of the fuel gas, such as the heat of combustion per unit volume Hρ, the Wobbe index $I_W$ and/or the methane number $N_M$, based on these parameters This can be done by using empirically determined correlation functions and/or lookup tables that correlate the measured parameters to one or more of these combustion parameters.

Measurement of Flow Rates

Figure 7:
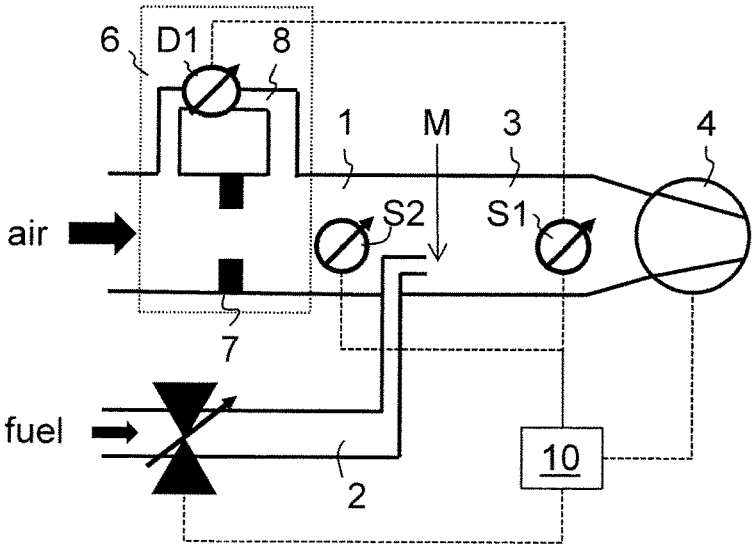
FIG. 7 shows, in a highly schematic manner, a regulation device according to a fourth embodiment.
Figure 8:
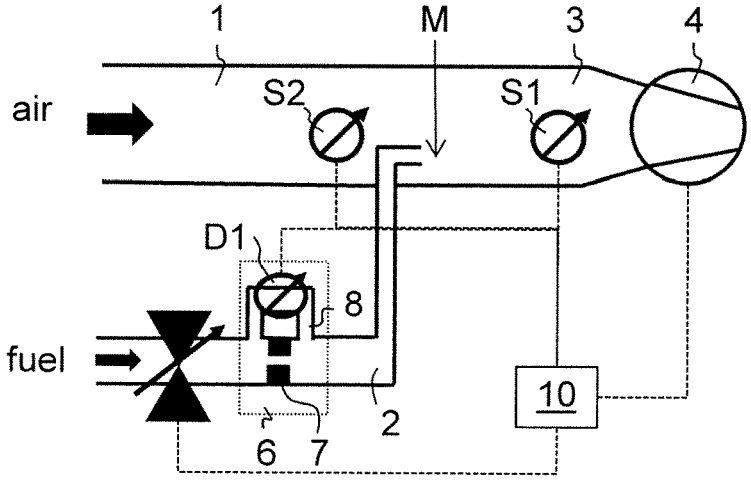
FIG. 8 shows, in a highly schematic manner, a regulation device according to a fifth embodiment.

As illustrated in FIGS. 7 and 8, it is possible to additionally measure the mass flow rate of the air flow in air conduit 1, of the fuel flow in fuel conduit 2, or the flow of the gas mixture in common conduit 3, using mass flow meters 6. In this manner it becomes possible to determine the absolute heating power of the gas mixture delivered to the gas burner. The mass flow rate(s) can be used to control fan 4 so as to regulate the heating power.

In the embodiment of FIG. 7, a mass flow meter 6 is arranged in the air conduit 1 upstream of the mixing region M. Mass flow meter 6 comprises a flow restrictor 7 in the air conduit 1 and a narrow bypass channel 8 that bypasses the flow restrictor 7. A flow sensor D1 measures a flow rate or flow velocity through the bypass channel 8, which flow rate/velocity is indicative of the differential pressure across the flow restrictor 7. The flow sensor D thus acts as a differential pressure sensor. Said differential pressure, in turn, is indicative of the mass flow through the flow restrictor 7.

In the embodiment of FIG. 8, a similarly designed mass flow meter 6 is arranged in the fuel conduit 2.

Figure 9:
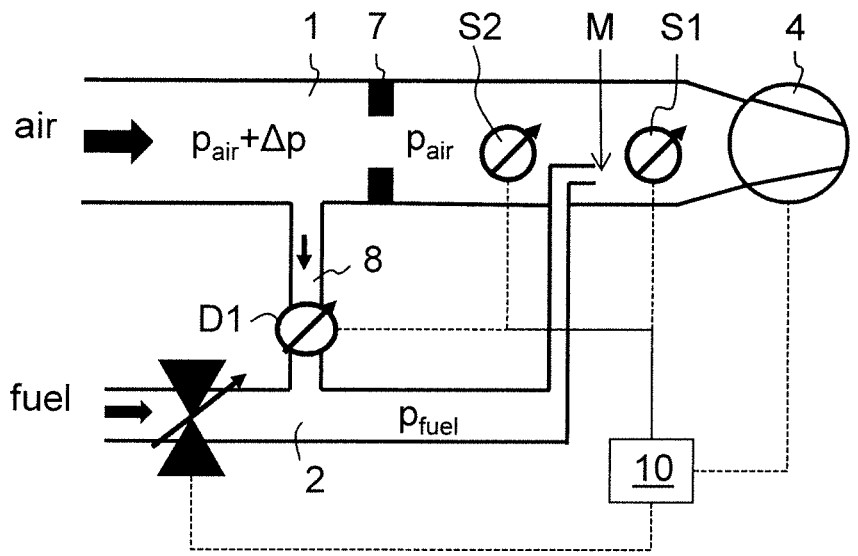
FIG. 9 shows, in a highly schematic manner, a regulation device according to a sixth embodiment.

As illustrated in FIG. 9, the mass flow rate in the air conduit 1 can also be determined by arranging a flow restrictor 7 in the air conduit 1 upstream from the mixing region M and measuring a differential pressure Δp between the air conduit 1 upstream of the flow restrictor 7 and the fuel conduit 2, using a narrow bypass channel 8 between these conduits. The differential pressure corresponds to the pressure across flow restrictor 7, assuming that the pressure $p_{air}$ in the air conduit 1 downstream from the flow restrictor 7 is the same as the pressure $p_{fuel}$ in the fuel conduit 2.

Figure 10:
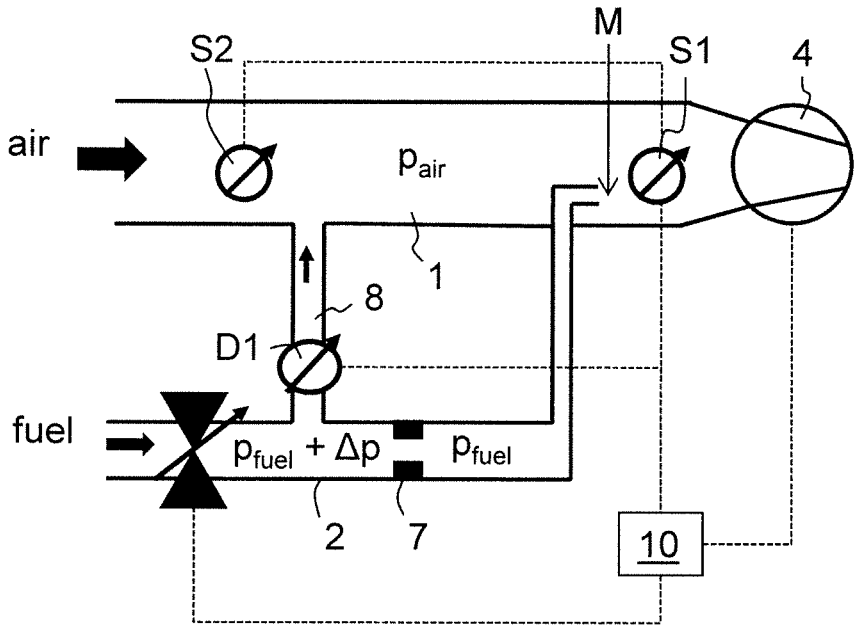
FIG. 10 shows, in a highly schematic manner, a regulation device according to a seventh embodiment.

As illustrated in FIG. 10, in the same spirit, the mass flow rate in the fuel conduit 2 can be determined by arranging a flow restrictor 7 in the fuel conduit 2 upstream from the mixing region M and measuring differential pressure Δp between the fuel conduit 2 upstream of the flow restrictor 7 and the air conduit 1.

Sensors S1, S2, S3, D1

Sensors that are capable of determining thermal parameters indicative of thermal conductivity and thermal diffusivity are well known in the art. Preferably a microthermal sensor is employed. Many types of microthermal sensors are known, and the present invention is not restricted to any specific type of microthermal sensor.

Figure 11:
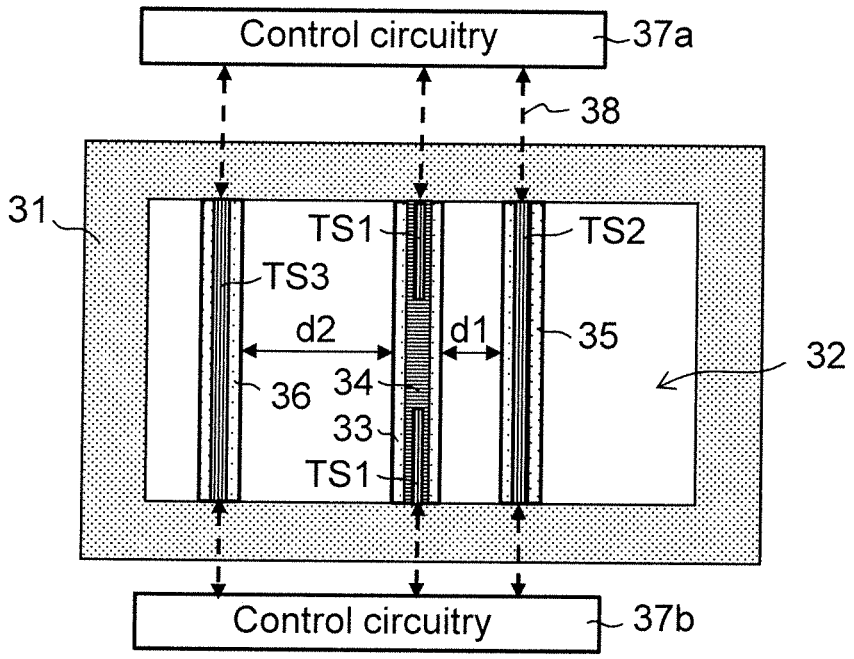
FIG. 11 shows, in a highly schematic manner, a micro-thermal sensor that may be used in conjunction with the present invention.

A possible implementation of a microthermal sensor that may be used in conjunction with the present invention is illustrated in FIG. 11. The microthermal sensor comprises a substrate 31, in particular a silicon substrate. The substrate 31 has an opening or recess 32 arranged therein. The microthermal sensor comprises a plurality of separate bridges that span this opening or recess 32. For details, reference is made to EP 3 367 087 A2.

In the example of FIG. 11, the microthermal sensor comprises a heating bridge 33, a first sensing bridge 35 and a second sensing bridge 36, each bridge spanning the recess or opening 2 and being anchored in the substrate 1. Each bridge may be formed by a plurality of dielectric layers, metal layers and poly-silicon layers. The metal layers or the poly-silicon layers form heating structures and temperature sensors, as will be described in more detail below. The dielectric layers may in particular comprise layers of silicon oxide and/or silicon nitride as dielectric base materials of the respective bridges. The sensing bridges 35, 36 are arranged at opposite sides of the heating bridge 33. The first sensing bridge 35 is arranged at a distance d1 to the heating bridge 33, and the second sensing bridge 36 is arranged at the same distance or at a different distance d2 to the heating bridge 33.

The heating bridge 33 comprises a heating structure 34 and a temperature sensor TS1 applied to a dielectric base material of e.g. silicon oxide. The heating structure 34 and the temperature sensor TS1 are electrically insulated from each other by the dielectric base material. The first sensing bridge 35 comprises a temperature sensor TS2. Likewise, the second sensing bridge 36 comprises a temperature sensor TS3. The temperature sensor TS1 is adapted to measure the temperature of the heating bridge 33, the temperature sensor TS2 is adapted to measure the temperature of the first sensing bridge 35, and the temperature sensor TS3 is adapted to measure the temperature of the second sensing bridge 36.

The microthermal sensor further comprises control circuitry 37*a*, 37*b* for controlling the operation of the microthermal sensor. The control circuitry 37*a*, 37*b* may be embodied as integrated circuitry on substrate 31. It includes circuitry for driving the heating structure 34 and for processing signals from the temperature sensors TS1, TS2 and TS3. To this end, the control circuitry 37*a*, 37*b* is electrically connected to the heating structure 34 and the temperature sensors TS1, TS2 and TS3 via interconnect circuitry 38. Advantageously, control circuitry 37*a*, 37*b* is integrated on substrate 31 in CMOS technology. Having the CMOS circuitry integrated on substrate 31 allows to reduce the number of bonds to the substrate and to increase signal-to-noise ratio. Structures of the type shown in FIG. 11 can e.g. be built using techniques such as described in EP 2 278 308 or US 2014/0208830.

Determination of Thermal Conductivity and Thermal Diffusivity

Using the microthermal sensor of FIG. 11, the thermal conductivity $\lambda$ and the volumetric heat capacity $c_p\rho$ of a gas to which the sensor is exposed can be determined in the manner described in EP 3 367 087 A2.

In particular, the thermal conductivity $\lambda$ can be determined by operating heating structure 34 to heat up to a steady-state temperature, which can be measured by temperature sensor TS1, and determining the steady-state temperatures at temperature sensors TS2 and/or TS3. The steady-state temperatures at sensors TS2 and TS3 depend on the thermal conductivity of the gas.

The volumetric heat capacity $c_p\rho$ can be determined by measuring the thermal conductivity of the gas at a plurality of different temperatures, determining coefficients of the temperature dependence of the thermal conductivity, and deriving the volumetric heat capacity from these coefficients, using a fitting function. For details, reference is made to EP 3 367 087 A2.

Once the thermal conductivity $\lambda$ and the volumetric heat capacity $c_p\rho$ are known, the thermal diffusivity D can be readily determined using the equation $D=\lambda/(c_p\rho)$ (Eq. (4)).

In addition, each of the temperature sensors TS1, TS2 and TS3 can be operated in the absence of heating power in order to determine the absolute temperature of the gas.

The different distances d1 and d2 can be used to perform differential measurements in order to eliminate the thermal transitions between the gas and the respective bridge. As an example, the ratio $(T_{S1}-T_{S2})/T_H$ could be taken as a measure of the thermal conductivity $\lambda$, wherein $T_{S1}$ denotes the measured temperature at the first sensing bridge 35, $T_{S2}$ the measured temperature at the second sensing bridge 36, and $T_H$ denotes the heating temperature at the heating bridge 33.

Other methods of determining thermal parameters indicative of thermal conductivity and thermal diffusivity of a gas, using a microthermal sensor, are known in the art, and the present invention is not limited to any particular method.

For instance, U.S. Pat. No. 4,944,035 B1 discloses a method of determining the thermal conductivity $\lambda$ and the specific heat capacity $c_p$ of a fluid of interest, using a microthermal sensor. The microthermal sensor comprises a resistive heater and a temperature sensor coupled by the fluid of interest. A pulse of electrical energy is applied to the heater of a level and duration such that both a transient change and a substantially steady-state temperature occur in the temperature sensor. The thermal conductivity of the fluid of interest is determined based upon a known relation between the temperature sensor output and thermal conductivity at steady-state sensor temperature. The specific heat capacity is determined based upon a known relation among the thermal conductivity, the rate of change of the temperature sensor output during a transient temperature change in the sensor, and the specific heat capacity.

U.S. Pat. No. 6,019,505 B1 discloses a method for determining the thermal conductivity, the thermal diffusivity and the specific heat capacity of a fluid of interest, using a microthermal sensor.

The microthermal sensor comprises a heater and a spaced temperature sensor, both coupled to the fluid of interest. A time-variable input signal is provided to the heater element, which heats the surrounding fluid. Variable phase or time lags between selected input and output AC signals are measured, and thermal conductivity, thermal diffusivity and specific heat capacity are determined therefrom.

Control Device

Figure 12:
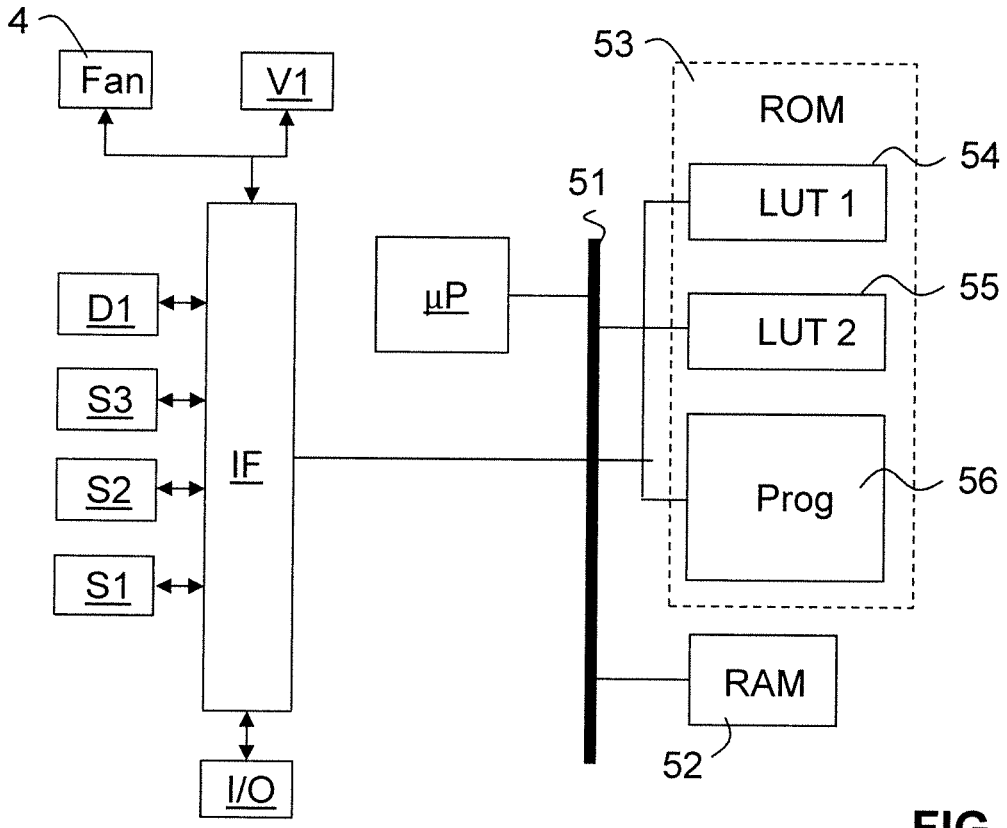
FIG. 12 shows, in a highly schematic manner, a block diagram of a control device that may be used in conjunction with the present invention.

A simplified and highly schematic block diagram of a digital control device 500 is shown in FIG. 12. The control device comprises a processor (CPU) μP, a volatile (RAM) memory 52, and a non-volatile (e.g., Flash ROM) memory 53, and. The processor μP communicates with the memory devices 52, 53 via a data bus 51. The non-volatile memory 53 stores, inter alia, plural sets of calibration data for the various sensors. In FIG. 12, only two exemplary sets of calibration data 54, 55 in the form of lookup tables LUT1, LUT2 are illustrated. The lookup tables can correlate, for instance, temperature values determined by the temperature sensors of the microthermal sensors to thermal parameters such as thermal conductivity or thermal diffusivity. The non-volatile memory 53 further stores a machine-executable program 56 for execution in the processor μP. Via a device interface IF, the control device communicates with the various sensors S1, S2, S3 and/or D1. The device interface further provides an interface for communicating with the fan 4 and with the fuel control valve V1, and with input/output devices I/O such as a keyboard and/or mouse, an LCD screen, etc.

Modifications

Many modifications are possible to the above embodiments without leaving the scope of the present invention.

In particular, air conduit 1 may carry a flow of another oxygen carrier gas than air. For instance, in embodiments that implement exhaust gas recirculation, air conduit 1 may carry a mixture of air with flue (exhaust) gas.

The fuel gas can be any combustible gas. Preferably the fuel gas is a natural gas.

The mixing of the oxygen carrier gas and the fuel gas can be carried out in a different manner than illustrated. For instance, the fuel gas may be injected into the oxygen carrier gas stream through a plurality of injection nozzles, which can be arbitrarily arranged, or the mixing can be carried out using a dedicated mixer.

The presently disclosed regulation device can be used not only in the context of a gas burner, but also in other applications where a mixture of a fuel gas and an oxygen carrier gas is required, such as in an internal combustion engine (gas motor or gas turbine).

Instead of arranging fan 4 at the downstream end of common conduit 3, it is possible to arrange fan 4 at another location. For instance, fan 4 may be arranged at the upstream end of air conduit 1. Any type of fan that is able to create a gas stream may be used, for instance, radial or axial fans as they are well known in the art. The control device 10 may be configured to not only control the fuel control valve V1, but also to control the fan power. An air valve or air flap may be present in the air conduit to additionally regulate the flow of the oxygen carrier gas through air conduit 1, and the control device 10 may be configured to also control the air valve or air flap.

In the above examples, the sensors S1, S2, S3 determine thermal conductivity and thermal diffusivity. However, it is also possible that the sensors determine any other thermal parameters that are related to thermal conductivity and thermal diffusivity, as long as it is possible to derive thermal conductivity and/or thermal diffusivity from the thermal parameters that are determined by the sensors. In the above example, the mixing ratio is controlled based on measurements of thermal conductivity. However, it is possible to base control of the mixing ratio on any other thermal parameter that is related to thermal conductivity and/or thermal diffusivity.

In the above examples, the mixing ratio x is explicitly determined from the measured thermal parameters and is used as the process variable in the control algorithm for regulating the fuel and/or air flows. This is, however, not necessary. For instance, the process variable of the control algorithm can be directly one of the thermal parameters determined by sensor S1 or a quantity derived therefrom, for instance, the thermal conductivity difference $\lambda_{mix}-\lambda_{air}$. The set point of the control algorithm then is a desired value of this difference. This set point can be predetermined or calculated from one or more of $\lambda_{fuel}$, $D_{fuel}$, $T_{fuel}$, $\lambda_{air}$, $p_{air}$, $T_{air}$ and $T_{mix}$.

The regulation device may be used for regulating entirely different kinds of binary mixtures of two gases. The gases can be termed a carrier gas and a functional gas. The air conduit of the above embodiment may thus be more generally be regarded as an example of a first conduit for the carrier gas, and the fuel conduit may be regarded as an example of a second conduit for the functional gas. For instance, the regulation device may be configured to regulate a mixture of an oxygen carrier gas and a medical gas, such as a gaseous anesthetic.

It will be appreciated by a person skilled in the art that various other modifications are possible without leaving the scope of the present invention.

The invention claimed is:

1. A regulation device for regulating a mixing ratio of a gas mixture comprising a first gas and a second gas, the device comprising:

a first conduit for carrying a flow of the first gas;

a second conduit for carrying a flow of the second gas, the first and second conduits opening out into a common conduit in a mixing region to form the gas mixture;

an adjusting device for adjusting the mixing ratio of the gas mixture;

a first sensor configured to determine at least one thermal parameter of the gas mixture downstream from the mixing region; and a control device configured to receive, from the first sensor, sensor signals indicative of the at least one thermal parameter of the gas mixture and to derive control signals for the adjusting device based on the at least one thermal parameter, wherein the control device is configured to carry out the following procedure:

setting the adjusting device to a reference state in which the flow of the second gas is interrupted while the flow of the first gas has a non-zero flow rate;

receiving sensor signals from the first sensor, the sensor signals being indicative of at least one thermal parameter of the first gas in the reference state;

setting the adjusting device to an operating state in which both the flow of the second gas and the flow of the first gas have non-zero flow rates;

receiving sensor signals from the first sensor, the sensor signals being indicative of at least one thermal parameter of the gas mixture in the operating state; and deriving the control signals based on a comparison of the at least one thermal parameter of the gas mixture in the operating state and of the at least one thermal parameter of the first gas in the reference state.

2. The regulation device of claim 1, wherein the adjusting device comprises a control valve for adjusting a flow rate of the second gas through the second conduit.

3. The regulation device of claim 1, wherein the first gas is an oxygen carrier gas and, the second gas is a functional gas.

4. The regulation device of claim 1, wherein the first sensor is configured to determine at least two thermal parameters of the gas mixture, the thermal parameters together being indicative of thermal conductivity and thermal diffusivity of the gas mixture, and wherein the control device is configured to take into account said at least two thermal parameters.

5. The regulation device of claim 4, wherein the control device is configured to derive the control signals based on one of the thermal parameters determined by the first sensor, and to carry out a consistency check based on another one of the thermal parameters determined by the first sensor.

6. The regulation device of claim 4, wherein the control device is configured to carry out the following procedure:

setting the adjusting device to a reference state in which the flow of the second gas is interrupted while the flow of the first gas has a non-zero flow rate;

receiving sensor signals from the first sensor, the sensor signals being indicative of the at least two thermal parameters in the reference state; and based on the at least two thermal parameters in the reference state, determining a pressure parameter that is indicative of a density or pressure of the first gas in the reference state.

7. The regulation device of claim 1, comprising a fan for transporting the gas mixture to a point of use.

8. The regulation device of claim 7, wherein the fan is arranged downstream from the mixing region, and wherein first sensor is integrated into the fan.

9. The regulation device of claim 7, wherein the control device is configured to carry out the following procedure:

operating the fan at a plurality of different power levels while the flow of the second gas is interrupted;

for each power level, determining a pressure parameter based on the sensor signals received from the first sensor, the pressure parameter being indicative of density or pressure of the first gas at said power level; and based on the pressure parameters at different power levels, deriving a blockage signal indicating whether a blockage or fan malfunction has occurred.

10. The regulation device of claim 1, further comprising a swirl element arranged in the common conduit downstream from the mixing region and upstream from the first sensor, the swirl element being configured to create turbulence in the gas mixture.

11. The regulation device of claim 1, further comprising a second sensor, the second sensor being configured to determine at least one thermal parameter of the first gas, wherein the control device is configured to receive, from the second sensor, sensor signals indicative of the at least one thermal parameter of the first gas and to derive the control signals based on the sensor signals received from both the first and second sensors.

12. The regulation device of claim 11, wherein the second sensor is configured to determine at least two thermal parameters, the at least two thermal parameters determined by the second sensor together being indicative of thermal conductivity and thermal diffusivity of the first gas, and wherein the control device is configured to derive, based on the at least two thermal parameters determined by the second sensor, a first pressure parameter indicative of density or pressure of the first gas.

13. The regulation device of claim 11, wherein the first sensor is configured to determine at least two thermal parameters, the at least two thermal parameters determined by the first sensor together being indicative of thermal conductivity and thermal diffusivity of the mixture, wherein the second sensor is configured to determine at least two thermal parameters, the at least two thermal parameters determined by the second sensor together being indicative of thermal conductivity and thermal diffusivity of the first gas, wherein the control device is configured to derive the control signals based on a comparison of one of the thermal parameters determined by the first and second sensors, and to carry out a consistency check based on a comparison of another one of the at least two thermal parameters determined by the first and second sensors.

14. The regulation device of claim 11, wherein the first sensor is configured to determine a temperature of the gas mixture, wherein the second sensor is configured to determine a temperature of the first gas, and wherein the control device is configured to carry out a consistency check based on a comparison of the temperatures of the gas mixture and the first gas.

15. The regulation device of claim 11, further comprising a third sensor, the third sensor being configured to determine at least one thermal parameter of the second gas, wherein the control device is configured to receive, from the third sensor, sensor signals indicative of the at least one thermal parameter of the second gas and to derive the control signals based on the sensor signals received from the first, second and third sensors.

16. The regulation device of claim 1, further comprising a first mass flow meter in the first conduit and/or a second mass flow meter in the second conduit, wherein the control device is configured to determine a mass flow parameter indicative of a mass flow in the first or second conduit based on mass flow signals from the first and/or second mass flow meters.

17. The regulation device of claim 1, further comprising:

a flow restrictor in the first or second conduit; and a differential pressure sensor configured to determine a differential pressure between the first and second conduits upstream from the flow restrictor, wherein the control device is configured to determine a mass flow parameter indicative of a mass flow in the first or second conduit based on differential pressure signals from the differential pressure sensor.

18. A method of regulating a mixing ratio of a gas mixture comprising a first gas and a second gas, the method comprising:

creating a flow of the first gas;

creating a flow of the second gas;

forming the gas mixture by mixing the flows of the first gas and the second gas in a mixing region;

determining at least one thermal parameter of the gas mixture downstream from the mixing region using a first sensor, and based on the at least one thermal parameter, adjusting the mixing ratio, wherein the method further comprises:

creating a reference state in which the flow of the second gas is interrupted while the flow of the first gas has a non-zero flow rate;

receiving sensor signals from the first sensor, the sensor signals being indicative of at least one thermal parameter of the first gas in the reference state;

creating an operating state in which both the flow of the second gas and the flow of the first gas have non-zero flow rates;

receiving sensor signals from the first sensor, the sensor signals being indicative of at least one thermal parameter of the gas mixture in the operating state; and adjusting the mixing ratio based on a comparison of the at least one thermal parameter of the gas mixture in the operating state and of the at least one thermal parameter of the first gas in the reference state.

19. The method of claim 18, wherein the first gas is an oxygen carrier gas and the second gas is a functional gas.

20. The method of claim 18, wherein adjusting the mixing ratio comprises operating a control valve for adjusting a flow rate of the second gas.

21. The method of claim 18, wherein at least two thermal parameters of the gas mixture are determined using the first sensor, the at least two thermal parameters together being indicative of thermal conductivity and thermal diffusivity of the gas mixture, and wherein the at least two thermal parameters of the gas mixture are taken into account when adjusting the mixing ratio.

22. The method of claim 21, wherein the mixing ratio is adjusted based on one of the thermal parameters determined by the first sensor, and wherein a consistency check is carried out based on another one of the thermal parameters determined by the first sensor.

23. The method of claim 21, comprising:

creating a reference state in which the flow of the second gas is interrupted while the flow of the first gas has a non-zero flow rate;

receiving sensor signals from the first sensor, the sensor signals being indicative of at least two thermal parameters of the first gas in the reference state; and based on the at least two thermal parameters of the first gas in the reference state, determining a pressure parameter that is indicative of a density or pressure of the first gas in the reference state.

24. The method of claim 19, comprising transporting the gas mixture to a point of use using a fan.

25. The method of claim 24, comprising:

operating the fan at a plurality of different power levels while the flow of the second gas is interrupted;

for each power level, deriving a pressure parameter from sensor signals determined by the first sensor, the pressure parameter being indicative of density or pressure of the first gas at said power level; and based on the pressure parameters at different power levels, deriving a blockage signal indicating whether a blockage or fan malfunction has occurred.

26. The method of claim 18, comprising:

determining at least one thermal parameter of the first gas upstream from the mixing region using a second sensor; and adjusting the mixing ratio based on the at least one thermal parameter of the gas mixture determined by the first sensor and on the at least one thermal parameter of the first gas determined by the second sensor.

27. The method of claim 26, wherein at least two thermal parameters are determined by the second sensor, the at least two thermal parameters determined by the second sensor together being indicative of thermal conductivity and thermal diffusivity of the first gas, the method comprising deriving a first pressure parameter based on the at least two thermal parameters determined by the second sensor, the first pressure parameter being indicative of density or pressure of the first gas.

28. The method of claim 26, comprising:

determining at least two thermal parameters of the gas mixture using the first sensor, the at least two thermal parameters determined by the first sensor together being indicative of thermal conductivity and thermal diffusivity of the gas mixture;

determining at least two thermal parameter of the first gas using the second sensor, the at least two thermal parameters determined by the second sensor together being indicative of thermal conductivity and thermal diffusivity of the first gas;

adjusting the mixing ratio based on a comparison of one of the thermal parameters determined by the first and second sensors; and carrying out a consistency check based on a comparison another one of the thermal parameters determined by the first and second sensors.

29. The method of claim 26, comprising:

determining a temperature of the gas mixture using the first sensor;

determining a temperature of the first gas using the second sensor; and carrying out a consistency check based on a comparison of the temperatures of the gas mixture and the first gas.

30. The method of claim 18, comprising:

determining at least one thermal parameter of the second gas using a third sensor; and adjusting the mixing ratio based on the at least one thermal parameter of the gas mixture determined by the first sensor and the at least one thermal parameter of the second gas determined by the third sensor.

31. The method of claim 18, further comprising determining a mass flow rate of the first gas and/or a mass flow rate of the second gas.

32. The method of claim 31, comprising:

passing the flow of the first gas or the flow of the second gas through a flow restrictor;

determining a differential pressure between the first gas and the second gas upstream from the flow restrictor; and determining a mass flow parameter indicative of a mass flow rate of the first gas or the second gas based on said differential pressure.

33. The regulation device of claim 1, wherein the at least one thermal parameter is a parameter that is indicative of thermal conductivity, thermal diffusivity, specific heat capacity, volumetric specific heat capacity, or a combination thereof.

34. The regulation device of claim 3, wherein the oxygen carrier gas is natural air, a mixture of air and exhaust gas, air enriched with oxygen, any other mixture of oxygen with one or more inert gases, or pure oxygen gas.

35. The regulation device of claim 3, wherein the functional gas is a fuel gas or a medical gas.

36. The regulation device of claim 11, wherein the control device is configured to compare the at least one thermal parameter of the gas mixture, as determined by the first sensor, and the at least one thermal parameter of the first gas, as determined by the second sensor.

37. The regulation device of claim 15, wherein the control device is configured to compare the at least one thermal parameter of the gas mixture, as determined by the first sensor, to the at least one thermal parameter of the first gas, as determined by the second sensor, and to compare said at least one thermal parameter of the first gas to the at least one thermal parameter of the second gas, as determined by the third sensor.

38. The method of claim 18, wherein the at least one thermal parameter is a parameter that is indicative of thermal conductivity, thermal diffusivity, specific heat capacity, volumetric specific heat capacity, or a combination thereof.

39. The method of claim 19, wherein the oxygen carrier gas is natural air, a mixture of air and exhaust gas, air enriched with oxygen, any other mixture of oxygen with one or more inert gases, or pure oxygen gas.

40. The method of claim 19, wherein the functional gas is a fuel gas or a medical gas.

41. The method of claim 26, wherein adjusting the mixing ratio comprises comparing the at least one thermal parameter of the gas mixture, as determined by the first sensor, and the at least one thermal parameter of the first gas, as determined by the second sensor.

42. The method of claim 30, wherein adjusting the mixing ratio comprises comparing the at least one thermal parameter of the gas mixture, as determined by the first sensor, to the at least one thermal parameter of the first gas, as determined by the second sensor, and comparing said the at least one thermal parameter of the first gas to the at least one thermal parameter of the second gas, as determined by the third sensor.

* * * * *